US012351950B2

(12) United States Patent
Griviau et al.

(10) Patent No.: US 12,351,950 B2
(45) Date of Patent: Jul. 8, 2025

(54) HEDDLE FOR WEAVING LOOM AND WEAVING LOOM PROVIDED WITH SUCH A HEDDLE

(71) Applicant: Staubli Lyon, Chassieu (FR)

(72) Inventors: Pierre-Alexis Griviau, Villeurbanne (FR); Patrice Przytarski, Chaponnay (FR)

(73) Assignee: STAUBLILYON, Chassieu (FR)

( * ) Notice: Subject to any disclaimer, the term of this patent is extended or adjusted under 35 U.S.C. 154(b) by 0 days.

(21) Appl. No.: 18/589,593

(22) Filed: Feb. 28, 2024

(65) Prior Publication Data

US 2024/0287712 A1 Aug. 29, 2024

(30) Foreign Application Priority Data

Feb. 28, 2023 (FR) ..... 2301854

(51) Int. Cl.
*D03C 9/02* (2006.01)
*D03C 3/00* (2006.01)

(52) U.S. Cl.
CPC ..... *D03C 9/024* (2013.01); *D03C 9/026* (2013.01)

(58) Field of Classification Search
CPC ..... D03C 9/024; D03C 9/026; D03C 9/02; D03C 9/0683; D03C 9/0608
See application file for complete search history.

(56) References Cited

U.S. PATENT DOCUMENTS 1,413,949 A * 4/1922 Wagner ..... D03C 9/024 139/96
1,930,151 A * 10/1933 Smith ..... D03D 51/20 139/94
3,960,182 A * 6/1976 Schwarz ..... D03C 9/02 139/96
4,355,665 A * 10/1982 Ramseier ..... D03C 9/024 139/96
5,819,809 A * 10/1998 Bassi ..... F16F 1/125 24/298

(Continued)

FOREIGN PATENT DOCUMENTS

CN 210596433 U 5/2020
EP 1908863 A1 4/2008
EP 3839115 A1 6/2021

OTHER PUBLICATIONS

Search Report issued in FR 2301854, dated Sep. 5, 2023.

*Primary Examiner* — Robert H Muromoto, Jr.
(74) *Attorney, Agent, or Firm* — MARSHALL, GERSTEIN & BORUN LLP

(57) ABSTRACT

This heddle includes a link and at least one rod made of polymeric material, one longitudinal extremity of which includes surfaces covering the transverse faces of the link. The rod and the link form at least one cavity, offset from the link parallel to a longitudinal axis and delimited by a first peripheral surface of the link, a second lateral surface, formed by the outer surface of the rod, and a third bottom surface, formed by the rod and extending one of the covering surfaces. An intersection line extends from the third bottom surface and delimits the first surface. The third bottom surface is arranged toward the outside of the rod relative to the second lateral surface. Each cavity is non-facing, according to a thickness axis in a direction away from the third bottom surface.

16 Claims, 11 Drawing Sheets

(56) References Cited

U.S. PATENT DOCUMENTS

| | | | | |
|---|---|---|---|---|
| 6,014,989 | A * | 1/2000 | Tachon | D03C 3/40 139/85 |
| 7,398,799 | B2 * | 7/2008 | Gaubert | D03C 3/40 139/65 |
| 7,464,730 | B2 * | 12/2008 | Mettler | D03C 9/024 139/92 |
| 7,469,723 | B2 * | 12/2008 | Himmelstoss | D03C 9/024 139/92 |
| 9,745,675 | B2 * | 8/2017 | Herrmann | D03C 9/02 |
| 9,777,409 | B2 * | 10/2017 | Herrmann | D03C 9/02 |
| 9,777,410 | B2 * | 10/2017 | Herrmann | D03C 3/00 |
| 10,260,176 | B2 * | 4/2019 | Himmelstoss | D03C 3/30 |
| 2007/0079887 | A1 * | 4/2007 | Korbutt | D03C 9/02 139/93 |
| 2016/0108561 | A1 * | 4/2016 | Herrmann | D03C 9/02 29/4.6 |
| 2016/0108562 | A1 | 4/2016 | Herrmann et al. | |
| 2016/0108563 | A1 * | 4/2016 | Herrmann | D03C 9/026 139/93 |
| 2018/0023224 | A1 * | 1/2018 | Himmelstoss | D03C 3/38 139/93 |

* cited by examiner

D—D

C—C

B—B

A—A

HEDDLE FOR WEAVING LOOM AND WEAVING LOOM PROVIDED WITH SUCH A HEDDLE

FIELD

The invention relates to a warp thread guiding heddle for a weaving machine equipped with a Jacquard mechanism, as well as to a weaving machine comprising a Jacquard mechanism and such a heddle.

The technical field of the invention is that of shedding on a weaving loom, by means of heddles each of which comprise an eyelet for the passage of one or more warp threads and which allow each to displace vertically one or more warp threads, to form a shed for the passage of weft threads. Such heddles are laid next to each other on the weaving loom, within a harness, with great density, which induces friction between a heddle and the warp threads passing through the eyelets of adjacent heddles.

BACKGROUND

It is known from EP-A-1 908 863 to overmold two rods of rounded cross-section onto a link of a heddle, by engaging a longitudinal extremity of each rod in a corresponding housing of the link. These housings are relatively large, which tends to weaken the link in the area where it is connected to the rods. On the other hand, burrs form during the overmolding operation, due to dispersions in the link dimensions and variations in the positioning of the link in a mold used during this operation. These burrs appear, in particular, at the intersection of a peripheral surface of the link with each rod. These burrs risk damaging, or even severing, a warp thread adjacent to the heddle once the latter has been mounted in a Jacquard-type weaving loom harness, as this warp thread is likely to become snagged with these burrs. These burrs must therefore be reduced, or even eliminated, after the overmolding operation, which requires a rework operation that is tricky to implement and time-consuming.

SUMMARY

The invention aims more particularly to remedy these problems by proposing a new heddle for Jacquard weaving looms, with which the risk of adjacent warp threads snagging during weaving is greatly reduced or even eliminated.

To this end, the invention relates to a warp thread guiding heddle for a Jacquard weaving loom, the heddle extending lengthwise according to a longitudinal axis and comprising:

- a link, with an eyelet for the warp thread to pass through, the eyelet passing through the link between a first transverse face and a second transverse face of the link, the first and second transverse faces being joined together by a peripheral surface of the link;
- at least one rod of polymeric material extending according to the longitudinal axis, which is provided with an outer surface and comprising
  - a first longitudinal extremity provided with means for connection to a member of a Jacquard harness, and
  - a second one-piece longitudinal extremity comprising at least
    - a first covering surface which partially covers the first transverse face of the link,
    - a second covering surface which partially covers the second transverse face of the link, and
    - an anchoring heel;

in which the first covering surface and the second covering surface are parallel to the longitudinal axis and to a transverse axis, itself perpendicular to the longitudinal axis;

in which the link cooperates with the anchoring heel of the rod to oppose separation of the rod and link parallel to the longitudinal axis.

In accordance with the invention, the rod and the link form, at the second longitudinal extremity of the rod, at least one cavity which is offset from the link according to a direction parallel to the longitudinal axis and which is delimited by:

- a first surface formed by a portion of the peripheral surface of the link;
- a second lateral surface formed by a portion of the external surface of the rod, this second lateral surface extending in the direction of the first longitudinal extremity of the rod, from an intersection line between the peripheral surface of the link and the external surface of the rod;
- a third bottom surface formed by the rod and extending one of the first and second cover surfaces in the direction of the first longitudinal extremity of the rod.

Within each cavity, the intersection line extends from the third bottom surface and delimits the first surface. Furthermore, for each cavity, the third bottom surface is arranged, according to a direction parallel to the transverse axis, toward the outside of the rod relative to the second lateral surface. Finally, each cavity is non-facing, according to an axis of thickness perpendicular to the longitudinal and transverse axes, in a direction away from a portion of the second rod that forms the third bottom surface of the cavity.

Thanks to the invention, the cavity formed in the vicinity of the second longitudinal extremity of the rod allows to have certain zones of the heddle, where burrs are most likely to form during overmolding of the rod onto the link, to be recessed inside the cavity. Thus, adjacent warp threads, which are taut and in contact with the outer surface of the heddle when the heddle is integrated into a Jacquard-type weaving loom harness, cannot come into contact with re-entrant edges formed in the cavity. This relates in particular to zones formed by the intersection line between the peripheral surface of the link and the outer surface of the rod, or by a re-entrant junction edge between the first and third bottom surfaces. This thus prevents adjacent warp threads from coming into contact with burrs, which tend to form in these zones. The risk of burrs snagging, damaging or cutting adjacent warp threads when using the heddle is therefore greatly reduced, if not eliminated. As there is no surface to limit the cavity according to the direction perpendicular to the first covering surface, in a direction away from the third bottom surface, the second longitudinal extremity of the rod can be overmolded in a mold without slides, which further limits the formation of burrs.

According to advantageous but not mandatory aspects of the invention, such a heddle may incorporate one or more of the following features taken in any technically permissible combination:

The third bottom surface of each cavity is coplanar or substantially coplanar with the covering surface it extends. The link comprises at least one housing passing through the link between the first transverse face and the second transverse face of the link. The anchoring heel passes right through the housing of the link according to the thickness axis. A contour surface of the housing comprises a proximal portion, arranged longitudinally on the side of the eyelet. The proximal portion of the housing is arranged, along the longitudinal axis, between the cavity or cavities formed at the rod and the eyelet. The anchoring heel forms the free edge of the second longitudinal extremity. The first and second covering surfaces of the rod extend to the anchoring heel.

The anchoring heel of the second longitudinal extremity of the rod is delimited by two surfaces respectively parallel to the first and second transverse faces of the link. The anchoring heel rests longitudinally against the proximal portion of the housing contour surface.

The intersection line extends to an edge which borders the second covering surface.

The heddle comprises two rods made of polymeric material, each with a first longitudinal extremity and a second longitudinal extremity. The second longitudinal extremities of the two rods each partially cover the first and second transverse faces of the link. Two cavities are formed at the second longitudinal extremity of each rod on either side of a plane containing the longitudinal and transverse axes and passing through a geometric center of the eyelet.

The two cavities formed at the same second longitudinal extremity of the same rod face away from each other according to the same direction parallel to the thickness axis. The link is plane and symmetrical relative to a geometric center of the eyelet.

The first surface is formed by a portion of the peripheral surface of the link in a transition zone of the link where the width of the link, taken according to the transverse axis, decreases away from the eyelet along the longitudinal axis.

The third bottom surface is delimited according to the transverse axis toward the outside of the rod by a joining edge which connects the third bottom surface to the outer surface of the rod, which is curved and the concavity of which faces toward the second bottom surface.

The joining edge extends at a distance from the intersection line, a minimum value of which is greater than or equal to half the thickness of the link, measured between the first and second covering surfaces according to the thickness axis.

A radius of curvature of the projection of the joining edge in a plane parallel to the longitudinal and transverse axes is greater than or equal to a radius of curvature of the projection of the first surface in this plane, preferably at least 1.5 times greater.

At the longitudinal level of the cavity and on the side of each covering surface according to the thickness axis, the second longitudinal extremity of the rod has a thickness, measured according to the thickness axis relative to the plane formed by the covering surface, which is greater than or equal to a thickness of the link measured between the first and second covering surfaces.

On the side of each covering surface according to the thickness axis, the second longitudinal extremity of the rod presents, longitudinally between the third bottom surface and a free edge of the second longitudinal extremity, a width, measured parallel to the transverse axis, decreasing in the direction of the free edge and a thickness, measured according to the thickness axis, decreasing in the direction of the free edge.

The link comprises at least one longitudinal lug at the extremity which is completely surrounded by the second longitudinal extremity of the rod.

According to a second aspect, the invention relates to a weaving loom equipped with a Jacquard mechanism and several heddles for guiding a warp thread, at least one of which is as mentioned above.

The operation of this Jacquard weaving loom is more reliable, with less risk of warp thread snagging, than those of the prior art.

BRIEF DESCRIPTION OF THE DRAWINGS

The invention will be better understood, and other advantages of the invention will become clearer in the light of the following description of three embodiments of a heddle in accordance with its principle and of a Jacquard weaving loom also in accordance with its principle, given by way of example only and made with reference to the appended drawings in which.

DESCRIPTION

Figure 11:
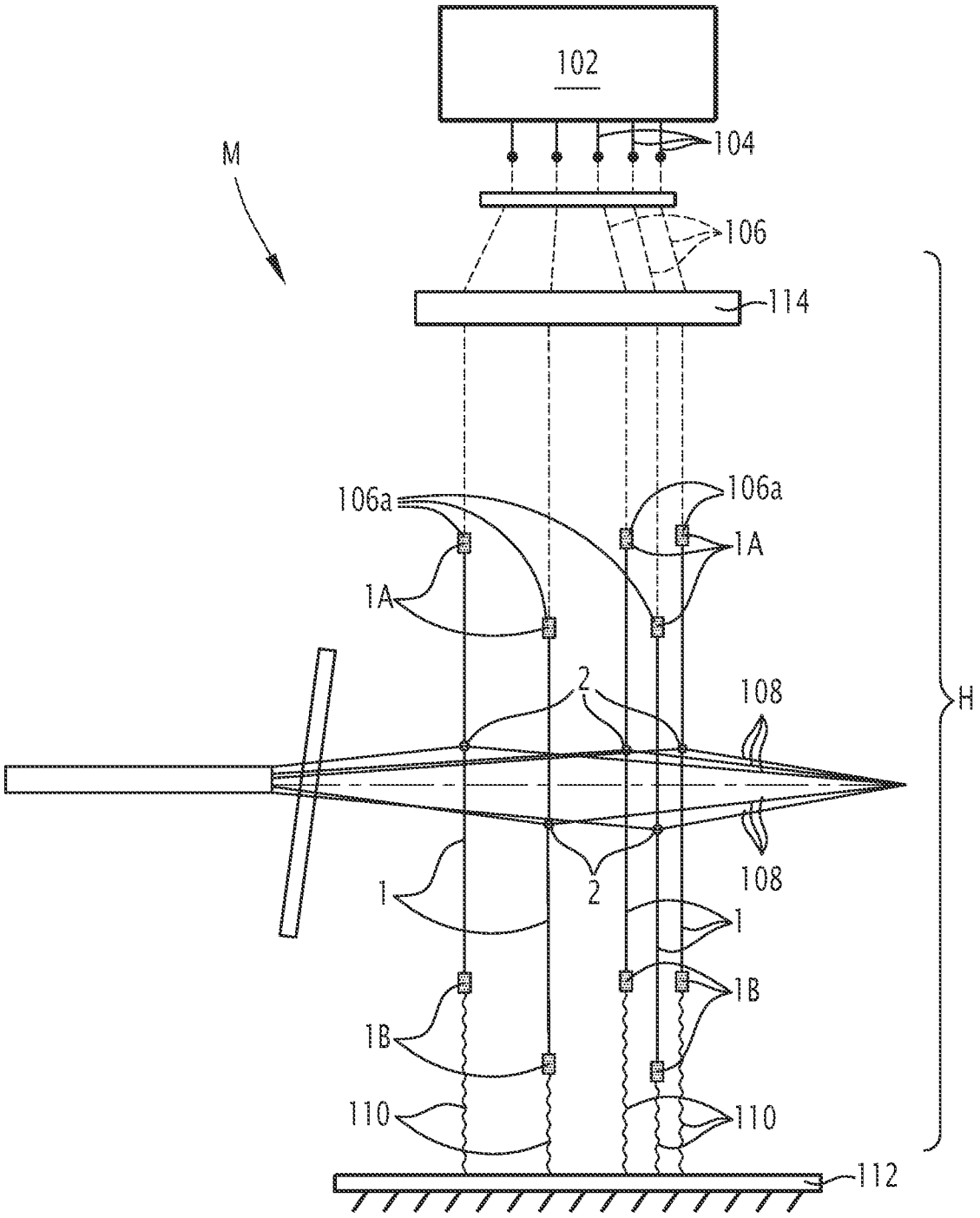
FIG. 11 is a schematic representation of a Jacquard-type weaving loom in accordance with the invention, incorporating at least one of the heddles shown in FIGS. 1 to 10, as well as a harness in accordance with the invention.

The Jacquard-type weaving loom M shown in FIG. 11 is equipped with a Jacquard mechanism 102 which controls a number of hooks 104. A lower extremity of each hook 104 is associated with a yoke 106. A lower extremity 106*a* of each yoke 106 is connected to an upper extremity 1*a* of a heddle 1 equipped with a link 2 guide for a warp thread 108. Each heddle 1 is connected by its lower extremity 1*b* to a spring 110 fixed to a hanging beam 112, the beam 112 being securely fixed to a frame, not shown, on the weaving loom M. The various yokes 106 are distributed, across the depth and width of the weaving loom, passing through holes arranged in a stuffing board 114. The elements 1, 106, 110 and 114 form a harness H belonging to the weaving loom M and controlled by the Jacquard mechanism 102.

The heddles shown in FIGS. 1 to 10 are intended to be integrated into the harness H.

FIGS. 1 to 7 show a first embodiment of a heddle 1 guide for a warp thread of the harness H on the weaving loom M.

The heddle 1 guide extends according to a longitudinal axis X1 and comprises a heddle body 10 and a link 2. The heddle body 10 includes two separate rods 4 arranged on either side of the link 2, along the longitudinal axis X1.

The rods 4 are made of a polymer, such as Nylatron (registered trademark) or natural polyamide PA6, preferably unfilled. They are overmolded onto the link 2, in other words, obtained by an overmolding operation around the link 2.

Overmolding means that link 2 is at least partially placed in an injection mold formed of at least two portions of the mold which together define a recess around the link 2. This recess is filled by injecting polymer material intended to form a rod 4. In practice, the two rods 4 of the heddle 1 are advantageously overmolded at the same time on the link 2 in a mold forming two recesses. Each of the rods constituted at the end of the overmolding operation is, preferably, one-piece. As explained below, each rod 4 is anchored in the link 2 by a part of the rod, called the heel, which is engaged in a housing defined by the link.

Y1 and Z1 are two axes of the heddle 1 which are perpendicular to the longitudinal axis X1. The axis Y1 extends according to the width of link 2, while the axis Z1 extends according to the thickness of the link 2. The Y1 axis constitutes a transverse axis for the heddle 1, while the axis Z1 constitutes a thickness axis for the heddle 1. The center of the reference frame formed by axes X1, Y1 and Z1 is located at the geometric center C22 of an eyelet 22 of the link 2.

At each extremity, the heddle body 10 presents hooking means 11A or 11B, respectively provided to cooperate with a yoke 106 or a spring 110. More precisely, one of the rods 4, shown in the upper part of FIG. 1, carries the hooking means 11A on a first extremity 42, while the other rod 4, shown in the lower part of FIG. 1, carries on a first extremity 42 the hooking means 11B. The hooking means 11A comprises an end piece 12 which forms an opening 14 for the passage and clamping of a yoke 106 by a tube, not shown, mounted around the upper rod 4. The hooking means 11B comprises an external thread 18 which is intended to be screwed into the spring 110 and a sliding damper 19.

The hooking means 11A and 11B are respectively arranged at the upper 1A and lower 1B extremities of the heddle 1 and are, preferably, manufactured by overmolding on the link 2, at the same time as the rest of the rods 4.

The examples of the hooking means 11A and 11B are not limiting. For example, the hooking means 11A may be in accordance with the teachings of CN-U-210596433.

The rods 4 are identical to each other, except for the hooking means 11A and 11B.

Opposite its first longitudinal extremity 42, each rod 4 comprises a second longitudinal extremity 44 by which it is connected to the link 2, by overmolding. Note that 44A is the free edge of the second longitudinal extremity 44 of a rod 4, which is opposite its first longitudinal extremity.

Each rod 4 comprises two portions 43 and 45, which are integral with each other, which define the longitudinal extremities 42 and 44 respectively, and which present a circular and non-circular cross-section respectively. Thus, the portion 43 has a circular cross-section, while the portion 45 has a non-circular cross-section. Along the longitudinal axis X1, the portion 43 is arranged between the portion 45 and the hooking means 11A or 11B, and the portion 45 is arranged between the portion 43 and the link 2.

Figure 1:
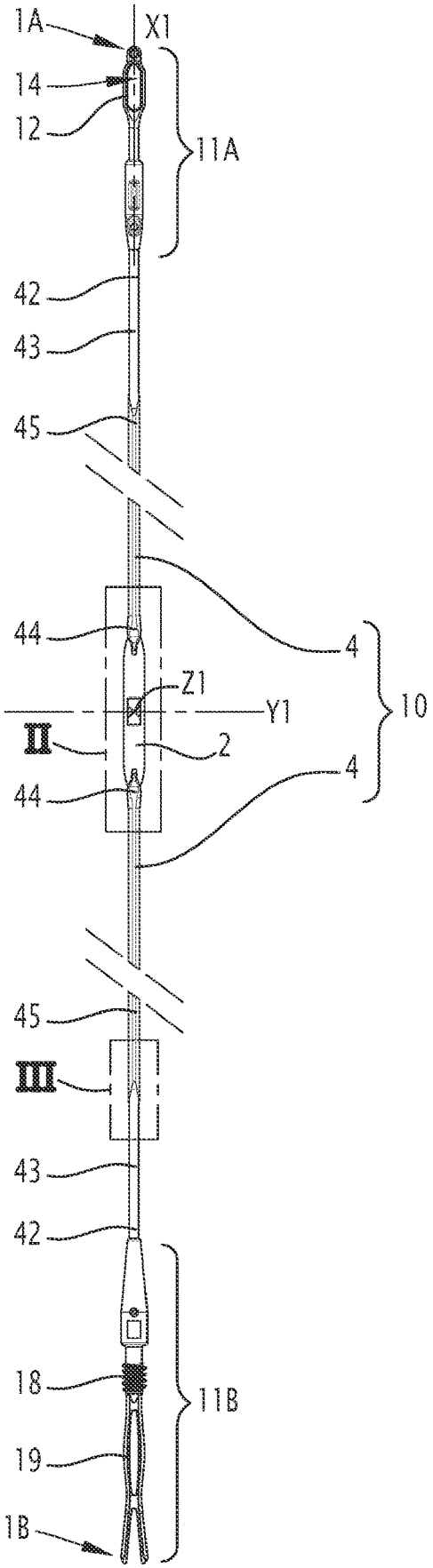
FIG. 1 is an elevation view of a warp thread guiding heddle for a Jacquard weaving loom, in accordance with a first embodiment of the invention.
Figure 2:
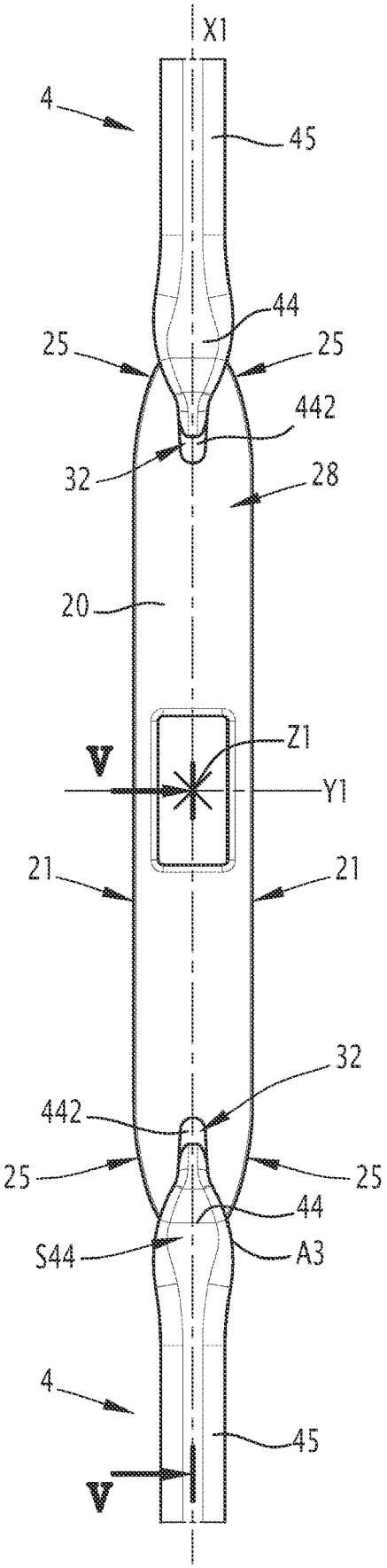
FIG. 2 is a larger scale view of detail II in FIG. 1.
Figure 3:
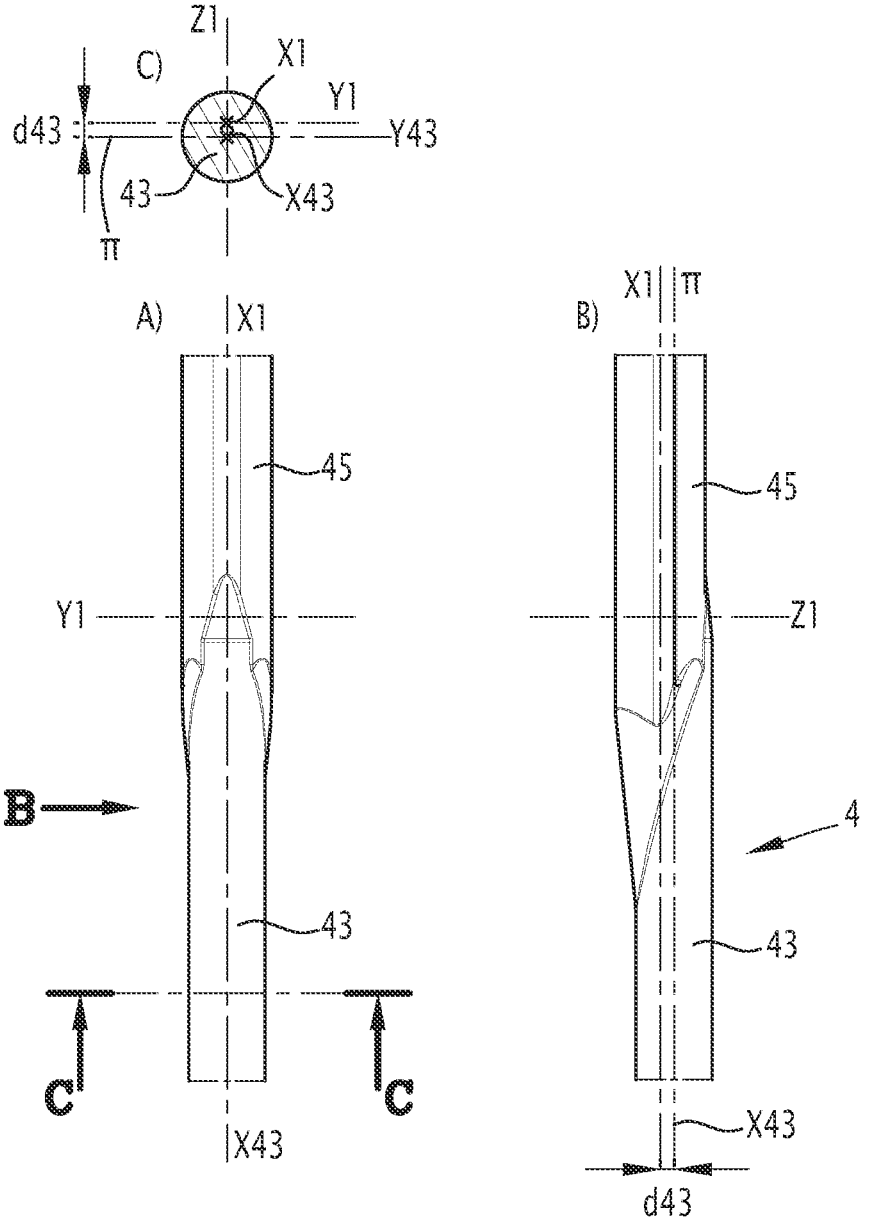
FIG. 3 shows, on insert A), a larger scale view of detail III in FIG. 1, on insert B), a side view in the direction of arrow B on insert A) and, on insert C), a section according to line C-C of insert A)
Figure 4:
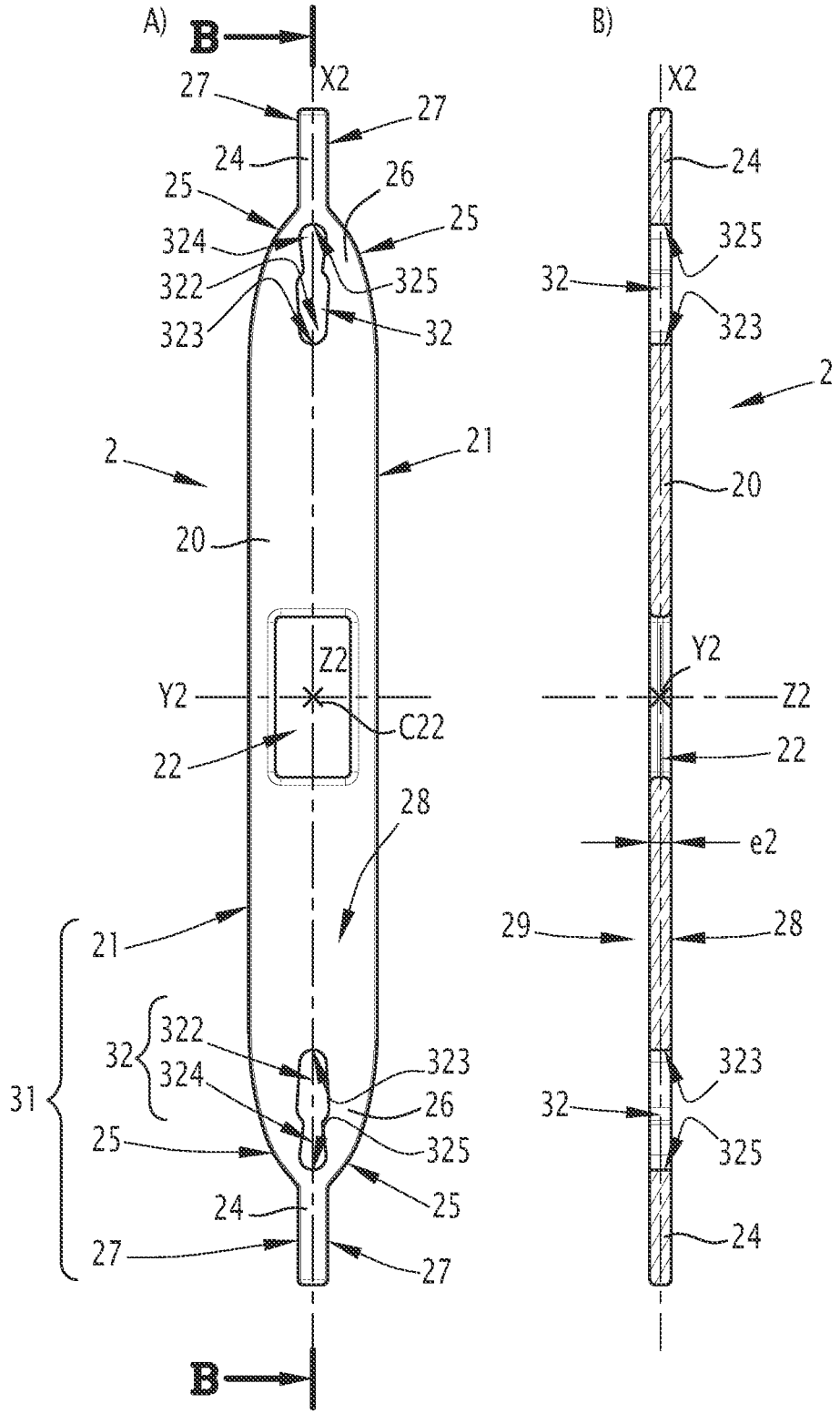
FIG. 4 shows, on two inserts A) and B), a front view and a longitudinal section according to plane B-B of a link belonging to the heddle of FIGS. 1 to 3.

As shown in FIG. 3, the circular cross-section of the portion 43 is centered on an axis X43 parallel to the longitudinal axis X1 and offset from the longitudinal axis X1 by a non-zero distance d43 measured parallel to the thickness axis Z1. A transverse axis is noted Y43 parallel to the transverse axis Y1 and offset relative to it by the distance d43, in the same direction as the axis X43 relative to the axis X1. The plane containing the axes X43 and Y43 is a plane of symmetry of the portion 43 of the rod 4.

The transverse section, perpendicular to the longitudinal axis X1, of the portion 45 is constant, except at the second longitudinal extremity 44 and its junction with the portion 43. In other words, the second longitudinal end 44 of the rod 4 is a part of the portion 45, the transverse section of which varies along the longitudinal axis X1.

The link 2 is formed from a sheet of metal of single thickness, preferably stainless steel. It is advantageously obtained by cutting a sheet of metal.

The link extends according to a longitudinal axis X2. A transverse axis, noted Y2, according to which the width of link 2 extends, and a thickness axis, noted Z2, according to which the thickness of this link extends. In the overmolded configuration of the rods 4 on the link 2, the axes X2, Y2 and Z2 are respectively coincident with the axes X1, Y1 and Z1.

The link 2 includes a central portion 20 which presents polished rounded lateral edges 21 and which defines the eyelet 22 for the passage of a warp thread 108, with rounded edges. This eyelet 22 passes right through the link 2 according to the thickness axis Z2. The axes X2, Y2 and Z2 intersect at the geometric center C22 of the eyelet 22 at mid thickness of the link. The eyelet 22 is rectangular in shape in the main plane of the link 2, which is the median plane of the central portion 20 and contains the axes X2 and Y2. The geometric center C22 is a point of symmetry of the link 2, which facilitates its placement in the mold for the overmolding operation of the rods 4, without any prerequisite as to its orientation.

The link 2 also comprises two longitudinal lugs 24 that extend its central part 20, according to the longitudinal axis X2, at its two opposite longitudinal extremities. The lugs 24 are longitudinal extremity lugs and each presents a reduced width relative to the width of the central portion 20. Between the central portion 20 and the lugs 24, the width of the link measured according to the transverse axis Y2 decreases progressively toward the lugs 24 and the lateral edges 21 of the central portion 20 are extended by curved edges 25, which between them delimit a transition zone 26 between the central portion 20 and a longitudinal lug 24.

In the example shown in the figures, the transition zone 26 is a zone where the width of the link 2 decreases away from the eyelet 22 along the longitudinal axis X1.

The lateral edges of the longitudinal lugs 24 are noted 27.

A first transverse face and a second transverse face of link 2, are noted 28 and 29 respectively. These transverse faces being parallel to the axes X2 and Y2. The first transverse face 28 is visible in FIGS. 1, 2, 4, 5 and on insert B) of FIG. 7, while the second transverse face 29 is visible in FIGS. 4, 5, 6 and on insert A) of FIG. 7. The transverse faces 28 and 29 are opposite each other and offset along the thickness axis Z2 by the thickness e2 of the link 2, which is constant. The transverse faces 28 and 29 extend over the entire surface of the link 2, from the eyelet 22 to the longitudinal lugs 24.

In each of the transition zones 26 is arranged an elongated housing 32, which constitutes an orifice and passes right through the link 2, between its transverse faces 28 and 29, in other words, parallel to the thickness axis Z2. The largest dimension of an elongated housing 32 extends according to the longitudinal axis X2.

A peripheral surface of link 2 is noted 31, in other words, the outer edge of this link excluding the eyelet 22 and outside the housings 32. The peripheral surface 31 includes the longitudinal edges 21, the curved edges 25 and the lateral edges 27.

Each elongated housing 32 comprises a first proximal lobe 322, on the side of the eyelet 22, and a second distal lobe 324, on the side of a longitudinal lug 24. The lobes 322 and 324 communicate with each other according to the longitudinal axis X2. Each housing 32 is thus keyhole-shaped overall.

The elongated housings 32 are symmetrical to each other relative to a plane containing the axes Y2 and Z2, which passes through the geometric center C22. Furthermore, each elongated housing 32 is symmetrical relative to a plane containing the axes X2 and Z2, which passes through the geometric center C22.

Each housing 32 is delimited by a closed contour which comprises, according to the longitudinal axis X2, a proximal portion 323, which defines the bottom of the proximal lobe 322 on the side of the eyelet 22, and a distal portion 325, which defines the bottom of the distal lobe 324 on the side of the nearest longitudinal lug 24.

The second longitudinal extremity 44 of each overmolded rod 4 partially covers the two transverse faces 28 and 29 of the link 2, at the transition zones 26, and passes through the link at the level of the housings 32, right through between the transverse faces 28 and 29. As it passes through the housing 32, the second longitudinal extremity 44 of each rod 4 forms an anchoring heel 442 which cooperates with the contour of this housing, in such a way that this cooperation opposes relative displacement between the rod 4 and the link, in both the longitudinal and transverse directions, in other words, parallel to the axes X1 and Y1. In particular, the cooperation of the heel 442 with the contour of the housing 32 opposes a separation of the rod 4 and the link 2 parallel to the longitudinal axis X1.

Figure 5:
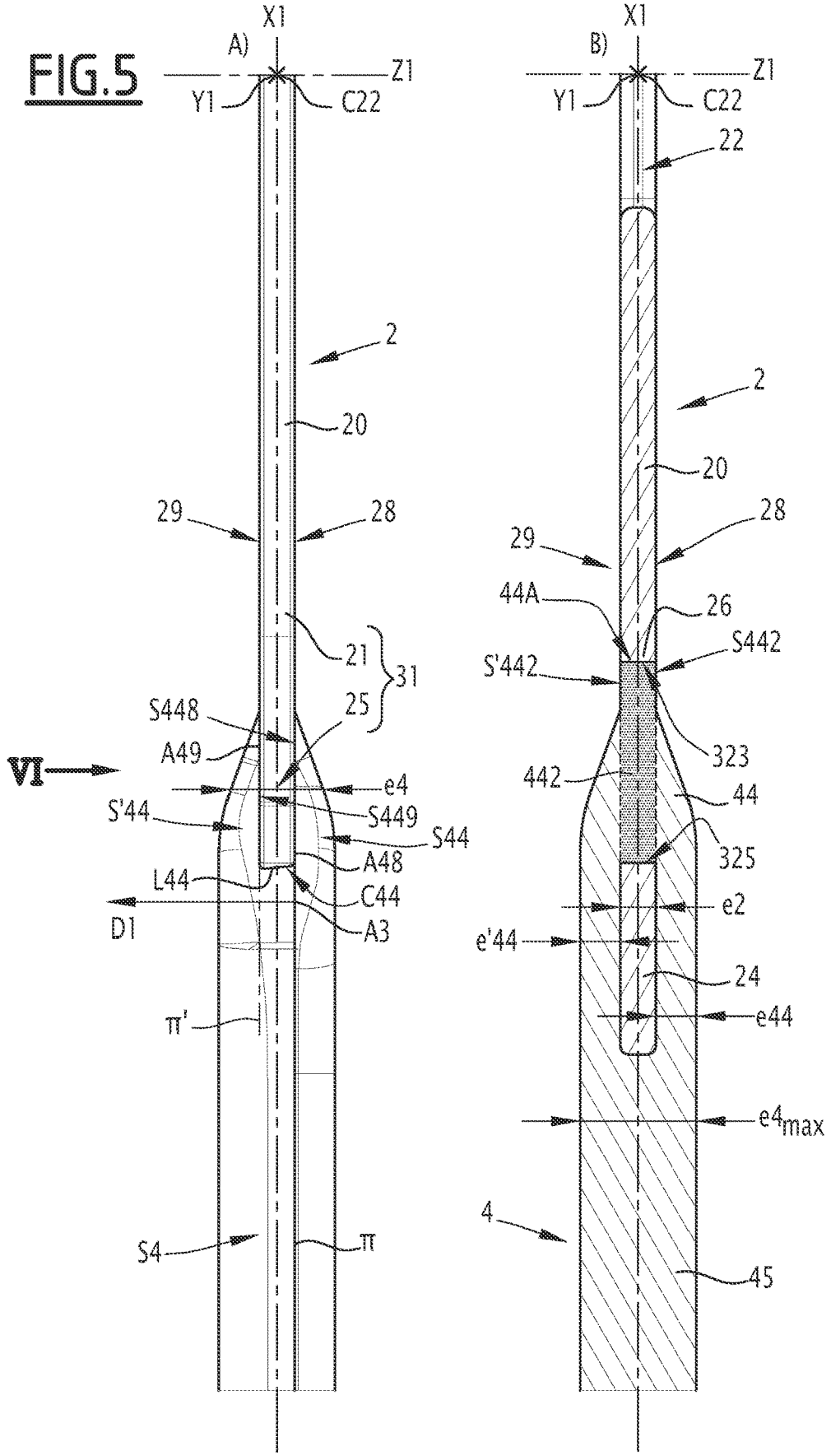
FIG. 5 shows, on two inserts A) and B), a side view of a junction zone between a rod and the link of the heddle of FIGS. 1 to 3, as well as a partial longitudinal section according to plane V-V in FIG. 2.

The trace of the anchoring heel 442 in the cross-sectional plane of insert B) in FIG. 5 is shaded. Each anchoring heel 442 is formed during overmolding on the link 2 of the rod 4 to which it belongs.

Each anchoring heel 442 passes right through the housing 32 in which it is formed, between the first and second transverse faces 28 and 29. The anchoring heel 442 passes seamlessly through the housing 32.

Each anchoring heel 442 completely fills the elongated housing 32 in which it is formed. In particular, the heel 442 rests against the proximal and distal portions 323 and 325 of the closed contour of this housing, which blocks any relative displacement of the second longitudinal extremity 44 relative to the link 2 according to the directions parallel to the longitudinal axis X1. This anchoring of the heel 442 in the housing 32 also blocks any displacement between the rod 4 and the link 2 according to a transverse direction, parallel to the transverse axis Y1.

In this embodiment, the part of the anchoring heel 442 resting against the proximal portion 323 of the closed contour of the housing 32 forms the free edge 44A of the second extremity 44 of the rod 4.

The second extremity 44 of a rod 4 presents a first covering surface S448 which partially covers the first transverse face 28 of the link 2, on a first side of a transition zone 26, and a second covering surface S449 which partially covers the second transverse face 29 of the link 2, on a second side of the same transition zone 26, opposite the first side according to the axis Z1. The trace of the covering surface S448 is shaded in FIG. 6. Each of the covering surfaces S448 and S449 is delimited by the anchoring heel 442. In other words, the covering surfaces S448, S449 extend as far as the anchoring heel 442. The covering surfaces S448 and S449 are coplanar with the first transverse face 28, the second transverse face 29 respectively, and therefore extend parallel to the plane formed by the axes X1, Y1 and perpendicular to the thickness axis Z1. A portion of the link 2 is therefore covered by, and embedded between, the two covering surfaces S448 and S449 of the second longitudinal extremity 44 of each rod 4. This prevents any relative displacement between the rod 4 and the link 2 in the two directions perpendicular to transverse faces 28 and 29, in other words, in the two directions parallel to the thickness axis Z1.

Thus, each second longitudinal extremity 44 of a rod 4 is integral with the link 2, with no possibility of movement in any direction.

The second longitudinal extremity 44 is in one piece. It defines the covering surfaces S448, S449 and comprises the anchoring heel 442. Thus, the covering surfaces S448, S449 and the anchoring heel 442 are obtained by filling the same recess in the same overmolding operation.

The portion of the anchoring heel 442 closest to the proximal portion 323 of the housing 32 is delimited according to the thickness axis Z1 by two surfaces S442 and S'442, respectively on the side of the first transverse face 28 and on the side of the second transverse face 29. The surfaces S442 and S'442 are flat and parallel to the adjacent transverse faces 28 and 29 respectively.

Advantageously, the surface S442 is flush with the first adjacent transverse face 28, while the surface S'442 is flush with the second adjacent transverse face 29. Thus, it is possible to limit snagging of adjacent warp threads 108 as they move into contact with the link 2.

On the side of each transverse face 28 or 29 of the link 2, the second longitudinal extremity 44 of a rod 4 has a curved external shape, with a thickness e4, measured according to the thickness axis Z1, which decreases as it approaches the heel 442, until it takes on a value equal to the thickness e2 of the link 2, at the level of the portion of the heel 442 defined between the surfaces S442 and S'442.

The width of the second longitudinal extremity 44 is noted $\ell$ 44 measured parallel to the transverse axis Y1 on the side of the transverse face 28. The width of the second longitudinal extremity 44 is noted $\ell$'44, measured parallel to the transverse axis Y1 on the side of the transverse face 29. On each side of the link 2, the width $\ell$ 44 or $\ell$'44 decreases as it approaches the free edge of the heel 442, until it takes on a value equal to the width of the free edge of the heel 442 or the proximal portion 323 of the elongated housing 32. Overall, on either side of the link 2, and as visible in FIG. 7, the second longitudinal extremity 44 of a rod 4 has a shape comparable to the head of a dolphin whose beak is constituted by the portion of the heel 422 delimited by the surface S442 or S'442.

Figure 6:
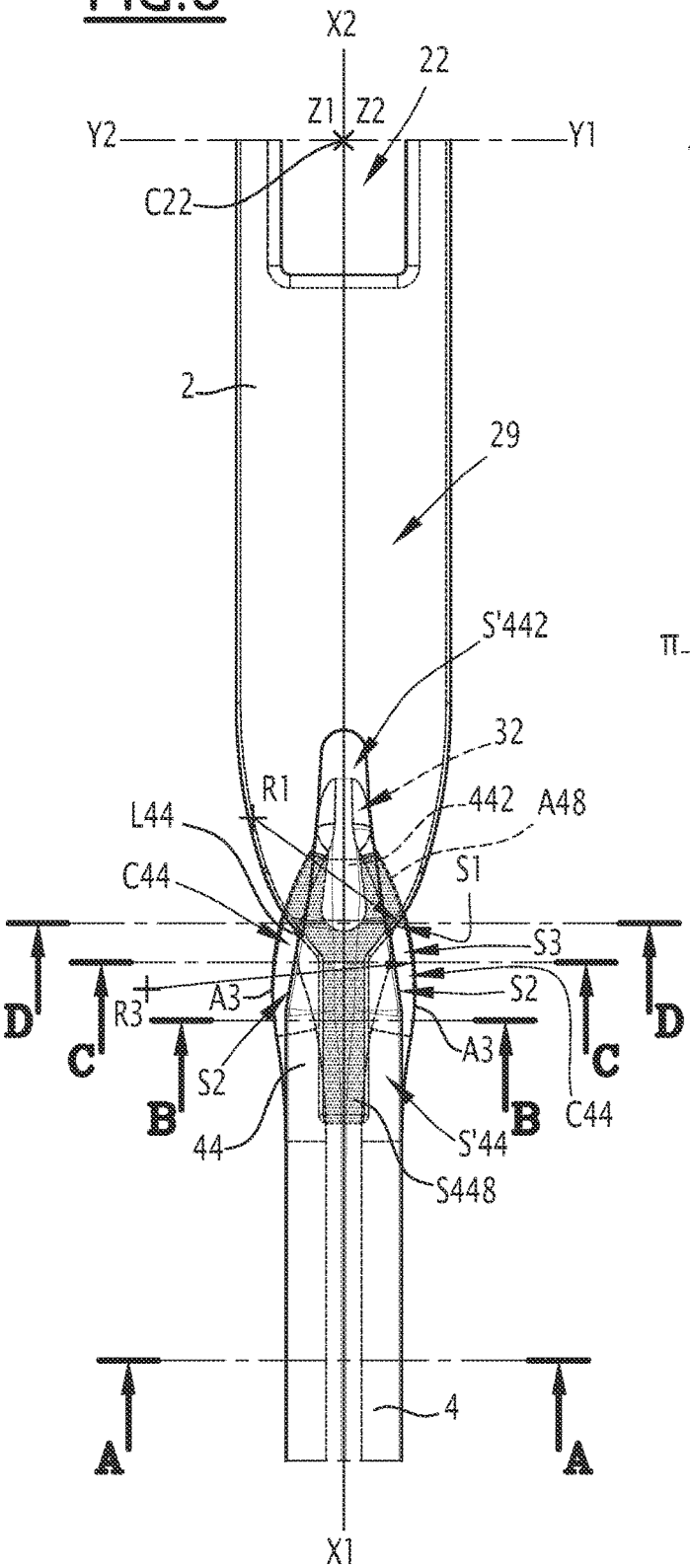
FIG. 6 shows the same junction zone in elevation in the direction of arrow VI in FIG. 5, as well as several sections taken at section lines A-A, B-B, C-C and D-D respectively.
Figure 6:
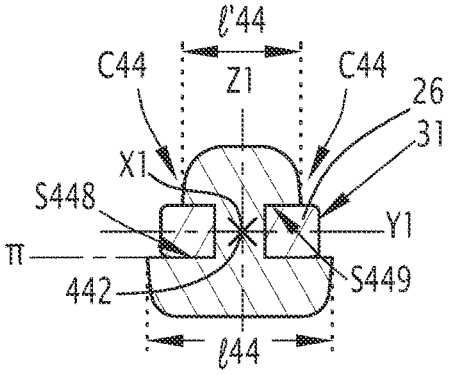
Figure 6:
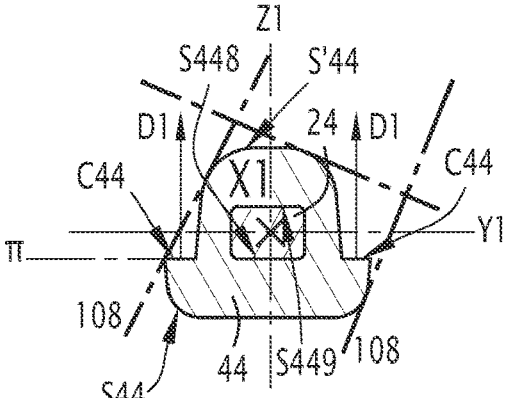
Figure 6:
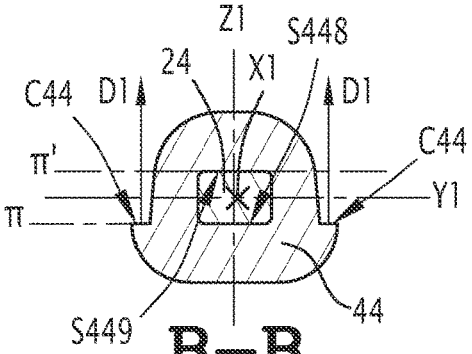
Figure 6:
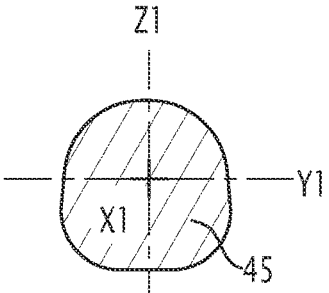

As can be seen from sections B-B and C-C of FIG. 6, the longitudinal lugs 24 are completely embedded in the second longitudinal extremities 44 of the rods 4. In other words, the lateral edges 27, the portions of the transverse faces 28, 29 and the free edge at each lug 24 are in contact with the associated second longitudinal extremity 44. In other words, each second longitudinal extremity 44 completely surrounds a longitudinal lug 24.

The outer surface of rod 4 is noted S4.

This outer surface S4 has a non-circular cross-section on the portion 45 and terminates, on the eyelet 22 side, with surfaces S442 and S'442.

It is considered that for each rod 4, a parting plane is defined by the mold in which the rod 4 is overmolded onto the link 2. This parting plane corresponds to a plane of closure of the two portions of the mold forming the recess for the rod 4 around the link 2. This parting line is parallel to, and in line with, the first transverse face 28 of the link 2. A plane forming the trace of the parting line on the heddle 1 is noted as π. The plane π includes the first transverse face 28 and the covering surface S448.

Figure 7:
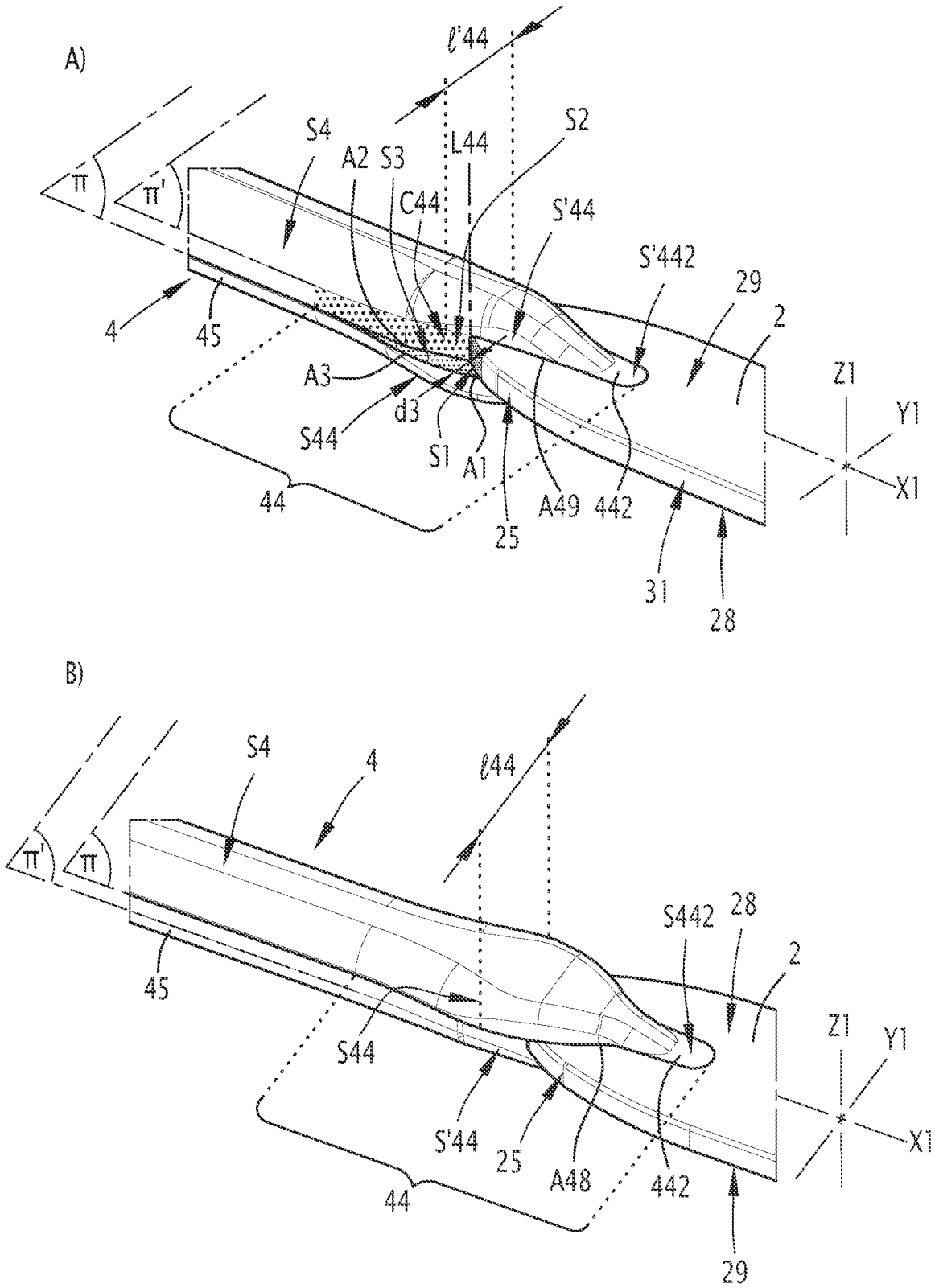
FIG. 7 shows, on two inserts A) and B), two perspective views of the junction zone, seen according to two different angles.

As can be seen from the comparison of inserts A and B in FIG. 7, the external shape of the extremity 44 is different when viewed from the side of the first transverse face 28 or from the side of the second transverse face 29. In other words, the geometry of the outer surface S4 is different according to when viewed from one side or the other of the rod 4, relative to the plane π on the rod 4. This geometry is imposed by the recess of the mold used during the overmolding operation.

More precisely, in a part of the second longitudinal extremity 44 along the longitudinal axis X1, the width $\ell'$44 is strictly less than the width $\ell$44.

A cavity C44 is formed by the rod 4 and the link 2 on either side of the second longitudinal extremity 44, relative to a plane containing the axes X1 and Z1. This cavity extends, according to the transverse axis Y1, beyond the part of the link 2 that is covered by the second extremity 44 of the rod 4.

The two cavities C44 arranged on the second longitudinal extremity 44 are symmetrical to each other relative to the plane containing the axes X1 and Z1. The following description applies to either of these cavities. The second longitudinal extremity referred to in the following is the second longitudinal extremity 44 of one of the rods 4.

The cavity C44 is defined by a first surface S1 of the link 2, by a second lateral surface S2 of the rod 4 and a third bottom surface S3 of the rod 4.

The bottom surface S3 extends, in the direction of the first longitudinal extremity 42, in particular according to the longitudinal axis X1, the first covering surface S448 formed by the second longitudinal extremity 44. In other words, the junction between the bottom surface S3 and the first covering surface S448 is a line contained in the plane formed by the first covering surface S448. In the first embodiment and in an advantageous way, the bottom surface S3 is in the plane π. The surfaces S3 and S448 are therefore coplanar. The third bottom surface S3 is in the extension, according to the longitudinal axis X1 and beyond the peripheral surface 31, of the first transverse face 28 of the link 2. In the first embodiment and in an advantageous way, the surface S3 and the first transverse face 28 are also coplanar.

Alternatively, the surfaces S3 and S448, of which, the surface S3 and the first transverse face 28, are substantially coplanar without being strictly coplanar, forming an angle of less than 10° between them.

The first surface S1 is constituted by a portion of a curved edge 25 of the link 2, which is arranged on the side of the third bottom surface S3 according to a direction parallel to the longitudinal axis X1. In other words, the first surface S1 is constituted by a portion of the peripheral surface 31, at one of the transition zones 26, where the width of the link decreases when moving away from the eyelet 22 according to the longitudinal axis X1.

The second lateral surface S2 is formed by a portion of the outer surface S4 which extends in the direction of the first longitudinal extremity 42 from a line L44 which forms the intersection between the outer surface S4 and the peripheral surface 31 of the link 2. Within the cavity C44, the intersection line L44 delimits the first surface S1. The intersection line L44 defines the junction between the first surface S1 and the second surface S2. The second surface S2 is said to be lateral in the sense that the second surface S2 is not parallel to the transverse axis Y1. The second lateral surface S2 therefore extends generally transversely toward the axis Y1. The second lateral surface S2 delimits the cavity C44 laterally, in other words, according to the transverse axis Y1, toward the inside, in other words, in the direction of the longitudinal axis X1. The intersection line L44 is arranged at the same longitudinal level as the second covering surface S449. The intersection line L44 extends from the first transverse face 28 to the second transverse face 29. In particular, the intersection line L44 extends from the first covering surface S448 to the second covering surface S449. The intersection line L44 extends, within the cavity C44, from the third bottom surface S3.

In insert A) of FIG. 7, the first, second and third surfaces S1, S2 and S3 are identified by zones with dots, with different densities, in order to facilitate their location. Similarly, an axis line has been added to the extension of the intersection line L44, to make it easier to locate.

The third bottom surface S3 extends laterally, in other words, according to a direction parallel to the transverse axis Y1, and away from the longitudinal axis X1, in other words, toward the outside, relative to the part of the link 2 located in the same zone as this bottom surface S3 along the longitudinal axis X1. In other words, the bottom surface S3 extends at a distance from the plane comprising the axes X1 and Z1 which is non-zero and which is greater than the distance between this plane and the portions of the peripheral surface 31 embedded in the material of the second longitudinal extremity 44, in particular the lateral edges 27 of the longitudinal lugs 24.

Thus, each cavity C44 is offset from the link 2 parallel to the transverse axis Y1.

In addition, each cavity C44 is advantageously offset from the link 2 parallel to the longitudinal axis X1. In other words, the third bottom surface S3 extends according to a direction parallel to the longitudinal axis X1, in the direction of the first longitudinal extremity 42, relative to the part of the link 2 located in the same zone as this bottom surface S3 along the longitudinal axis Y1.

In this case, the cavity C44 is offset from the link 2 parallel to all directions of the transverse faces 28 and 29 of this link, in other words, in all directions parallel to the covering surfaces S448 and S449. In other words, the cavity C44 is arranged laterally on the outside of the link and longitudinally beyond, in the direction of the first longitudinal extremity 42, the parts of the link not covered by the second extremity 44.

A first re-entrant edge A1 is defined at the junction between the first surface S1 and the third bottom surface S3. This edge A1 also corresponds to the junction line between the first covering surface S448 and the third bottom surface S3. This edge A1 extends to the intersection line A44.

A second re-entrant edge A2 defines the junction between the second lateral surface S2 and the third bottom surface S3. The second lateral surface S2 and the third bottom surface S3 meet at the edge A2. The edge A2 extends generally according to the longitudinal axis X1.

An outer edge A3 delimits the third bottom surface S3 laterally toward the outside. The edge A3 is a junction edge between one extremity of the edge A1 opposite the intersection line L44 and one extremity of the junction edge A2 opposite this same intersection line. This edge A3 is protruding and connects the third bottom surface S3 to a portion S44 of the outer surface S4 which defines the outer shape of the second longitudinal extremity 44 on the side of the transverse face 28 of the link 2, in other words, on the side visible on insert B) in FIG. 7. In other words, the bottom surface S3 opens onto the portion S44 of the outer surface S4. The portion of the surface S44 extends the surface S442 away from the eyelet 22.

In other words, the cavity C44 is defined by:

- a re-entrant dihedron between the surfaces S1 and S2, with the intersection line L44 as the common line,
- a re-entrant dihedron between the surfaces S1 and S3, with the edge A1 as the common line, and
- a re-entrant dihedron between the surfaces S2 and S3, with the edge A2 as the common line.

Each of the cavities C44 constitutes a reinforcement in which the presence of burrs is not objectionable, as there is no risk of these burrs coming into contact with warp threads adjacent to the heddle 1, when the latter is integrated into the harness H and when the weaving loom M is in operation.

In particular, on each side of the plane X1, Z1, each cavity C44 constitutes a recess for the intersection line L44 which is the sole junction of the outer surface S4 of the rod 4 with the peripheral surface 31 of the link 2 on this side of the plane X1, Y1.

A plane parallel to axes X1 and Y1 and which includes the transverse face 29 and the covering surface S449 is noted π'.

According to the thickness axis Z1, the second lateral surface S2 is between the planes π and π'.

A portion of the outer surface S4 located on the side of the π' plane opposite the lateral surface S2 is noted S'44. The portion of the surface S'44 is visible in insert A) of FIG. 7 and opposite the portion of the surface S44. It extends the surface S'442 away from the eyelet 22.

The width ℓ44 is the width of surface S44 and width ℓ'44 is the width of the surface S'44, measured parallel to transverse axis Y1. The widths ℓ44 and ℓ'44 decrease from the bottom surface S3 toward the free edge of the heel 442.

The third bottom surface S3 extends according to a transverse direction parallel to the transverse axis Y1, toward the outside, relative to the second side surface S2.

The thickness of the rod 4 measured parallel to the thickness axis Z1 is noted e4*max*, in the part of the portion 45 of the rod 4 with constant cross-section. The embedding thickness of the link 2 is noted e44, in the second longitudinal extremity 44, on the side of the first transverse face 28. The thickness e44 is the maximum distance, measured parallel to the thickness axis Z1 at the longitudinal level of the cavities C44, in other words, longitudinally between the intersection of the edges A3 and A2 and the intersection of the edges A3 and A1, between the plane of the first covering surface S448 and the surface S44. The embedding thickness of the link 2 in the second longitudinal extremity 44, on the side of the second transverse face 29, is noted e'44. The thickness e'44 is the maximum distance, measured parallel to the thickness axis Z1 at the longitudinal level of the cavities C44, between the plane of the second covering surface S449 and the surface S'44. The following relationship applies:

$$e4\max = e2 + e44 + e'44. \quad \text{(equation 1)}$$

Each of the thicknesses e44 and e'44 is greater than or equal to the thickness e2. The following relationships apply:

$$e44 \geq e2 \quad \text{(equation 2)}$$

$$e'44 \geq e2 \quad \text{(equation 3)}$$

At the longitudinal level of the cavity C44, the outer surface S4 of the rod 4 presents a maximum height, measured parallel to the thickness axis Z1 relative to the plane of the first covering surface S448, which is equal to e'44+e2 and is therefore greater than or equal to twice the thickness e2.

A re-entrant edge which extends to the junction between the surface S44 and the transverse face 28 is noted A48. This edge is contained in the plane π and borders the covering surface S448 on the outside. A re-entrant edge which extends to the junction between the surface S'44 and the transverse face 29 is noted A49. This edge is contained in the plane π' and borders the covering surface S449 on the outside. Each intersection line L44 of each of the two cavities C44 present on the rod 4 extends to the edge A49.

When the heddle 1 is integrated into the harness H, the adjacent warp threads can be considered as straight because they are taut and extend generally according to a direction transverse to the axis X1. In this case, if one of these threads comes to rub against the second longitudinal extremity 44, it comes into contact with one or other of the surfaces S44 or S'44 but cannot penetrate inside one of the cavities C44, given their geometry. Under these conditions, there is no risk of such a thread being snagged, damaged or severed by burrs that are found inside this cavity.

However, it is inside each cavity C44 that burrs are most likely to form, along the intersection line L44 and/or along one of the edges A1 and A2.

Different positions of a warp thread 108 resting against the second longitudinal extremity 44 of the heddle 1 are represented by thick mixed lines in section C-C of FIG. 6. The geometry of the second longitudinal extremity 44 maintains the warp thread 108 outside the two cavities C44, at a distance from the edges A1, A2 and the line L44.

The edge A3 is flat and is contained in the plane π, parallel to the axes X1 and Y1. Its concavity is turned toward the plane comprising the axes X1 and Z1 and therefore toward the second lateral surface S2. In other words, the edge A3 bulges outward between the edges A1 and A2, in a plane parallel to the axes X1 and Y1.

On the other hand, no surface of the heddle 1 faces the cavity C44 away from the third bottom surface S3 according to the thickness axis Z1 perpendicular to this third bottom surface, and therefore perpendicular to the covering surface S448. In other words, the cavity C44, and in particular, the third bottom surface S3, the first surface S1 and the second lateral surface S2, face away from each other in a direction D1 parallel to the thickness axis Z1 and away from the portion of the second longitudinal extremity 44 of the rod 4 that forms this surface S3. This allows the cavity C44 to be created by means of a mold with a parting line π and no slide, which is advantageous in terms of cost, reliability of the overmolding operation and reduced burrs.

The first surface S1 and the joining edge A3 each have a projection, in a plane parallel to the longitudinal and transverse axes X1, Y1, which is an arc of a circle. The radius of curvature of the projection of surface S1 in a plane parallel to the axes X1 and Y1 is noted R1, in other words, of the portion of the curved edge that delimits the cavity C44. The radius of curvature of the projection of the edge A3 in the same plane parallel to the axes X1 and Y1 is noted R3. The radii of curvature R1 and R3 are shown in FIG. 6. The radius of curvature R3 is greater than or equal to the radius of curvature R1, preferably greater than or equal to 1.5 times this radius R1.

This relatively large radius of curvature R3 of the edge A3, compared with that of the curved edge 25, gives the bottom surface S3 a tapered geometry, advantageous for preventing a warp thread 108 from engaging in the cavity C44 defined by this joining edge A3.

Each housing 32 is arranged, along the longitudinal axis X1, predominantly on the side of the eyelet 22 relative to the cavities C44 of the adjacent second longitudinal extremity 44. In particular, the proximal portion 323 of a housing 32 is arranged, along the longitudinal axis X1, between the nearest cavities C44 and the eyelet 22. In an alternative not represented, the distal portion 325 of a housing 32 is arranged, along the longitudinal axis X1, between the nearest cavities C44 and the eyelet 22.

For each rod 4, each covering surface S448, S449 is predominantly, preferably exclusively, arranged at the longitudinal level of each cavity C44 as well as on the longitudinal side of the eyelet 22 relative to each cavity C44.

Advantageously, at the level of each second longitudinal extremity 44, the two cavities C44 have first surfaces S1, two second lateral surfaces S2 and third bottom surfaces S3 which are not facing each other according to the same direction D1, perpendicular to the transverse faces 28 and 29 of the link 2. Furthermore, the two third bottom surfaces S3 of the two cavities C44 of the same rod 4 are coplanar.

In practice, taking into account that two cavities C44 are provided at each of the second longitudinal extremities 44 of the two rods 4, the heddle 1 has four cavities C44. The four third bottom surfaces S3 of these four cavities C44 are advantageously coplanar, which allows, for the overmolding mold of the rods 4, to use a single parting line, which simplifies the manufacture of this mold and also reduces burrs at this parting line.

The plane π is offset from the median plane of the eyelet 22, which contains the axes X1 and Y1, by half the thickness e2 of this eyelet. This allows the third bottom surface S3 to be in the extension of with the covering surface S448 and the transverse face 28.

In addition, the distance d43 is equal to half the thickness e2. Thus, the axis X43 is contained in the plane π and the plane of symmetry X43, Y43 of portion 43 of the rod 4 is coplanar with the third bottom surface S3 of each cavity C44. This means that the portion 43 of each rod 4 is symmetrical relative to the parting line of the mold.

The second longitudinal extremities 44 of the two rods 4 are symmetrical to each other relative to a plane parallel to the axes Y1 and Z1 and passing through the center of the eyelet 22. As a result, the plane π is the same for both rods. Once again, this simplifies mold manufacturing and limits burrs.

The distance measured between the junction edge A3 and the intersection line L44 is noted d3. Advantageously, the minimum value of the distance d3 is greater than or equal to half the thickness e2 of the link 2. When the junction edge A3 is contained in the plane π, then d3 is the distance measured in the plane π between the junction edge A3 and the trace of intersection line L44 in this plane. In practice, the minimum value of the distance d3 can be chosen between 0.1 and 0.15 millimeters, which gives good results for sufficiently spacing the warp threads 108 from the burrs present inside the cavity C44, without significantly widening or weighing down the rod 4.

In view of the above, it is understood that the effect of the cavities C44 is that the intersections between the rods 4 and the link 2 that are most critical in terms of burr creation, namely those intersections that are essentially perpendicular to the longitudinal axis X1, in particular at the intersection line L44 and the edges A1, are set back in each cavity C44, therefore, at a distance from an adjacent warp thread 108 that presses against one or other of the surfaces S44 or S'44, as represented in section C-C of FIG. 6.

This applies in particular at the intersection line L44, which is perpendicular, to within 10°, to the third bottom surface S3.

In an alternative, not represented, the intersection line L44 is curved.

Burrs can also be created during the overmolding operation, on essentially rectilinear portions of the rod 4, parallel to the longitudinal axis X1 and located outside the second extremity 44, therefore outside the cavities C44. These burrs are less aggressive than those that may be created in zones that are not parallel to the longitudinal axis X1.

Other burrs can also be created along the re-entrant edges A48 and A49, but they do not risk snagging the warp threads 108 as these are straight and come to rest against the peripheral surface 31 of the link 2 and against one of surfaces S44 and S'44, without touching the edges A48 and A49.

Figure 8:
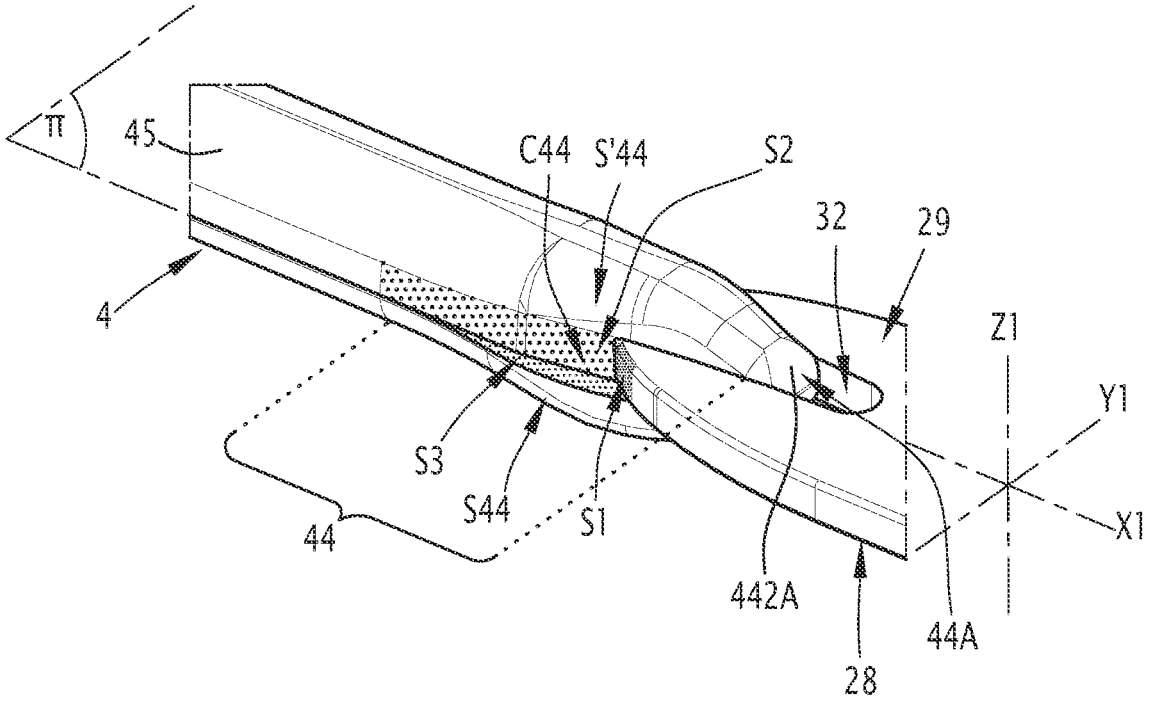
FIG. 8 is a view similar to insert A) of FIG. 7 for a heddle in accordance with a second embodiment.

In the second and third embodiments shown in FIG. 8 and following, elements similar to those in the first embodiment carry identical references. If a reference is shown on one of FIG. 8 and following without being mentioned in the rest of the description or mentioned in the description without being shown on these figures, it relates to the same element as the one carrying the same reference in the first embodiment. In the following, we will mainly describe what distinguishes the Jacquard heddle guides of these second and third embodiments from the first embodiment.

In the second embodiment, the housings 32 of the link 2 are notches which open out at the longitudinal extremities of this link. In other words, no lugs comparable to the longitudinal lugs 24 of the first embodiment are provided, and the contour of the housings 32 is open. This contour does not comprise a portion comparable to the distal portion 325 of the first embodiment. The peripheral surface 31 is defined outside the contour of the housings 32 and outside the eyelet 22 and includes the longitudinal edges 21 and the curved edges 25.

Figure 9:
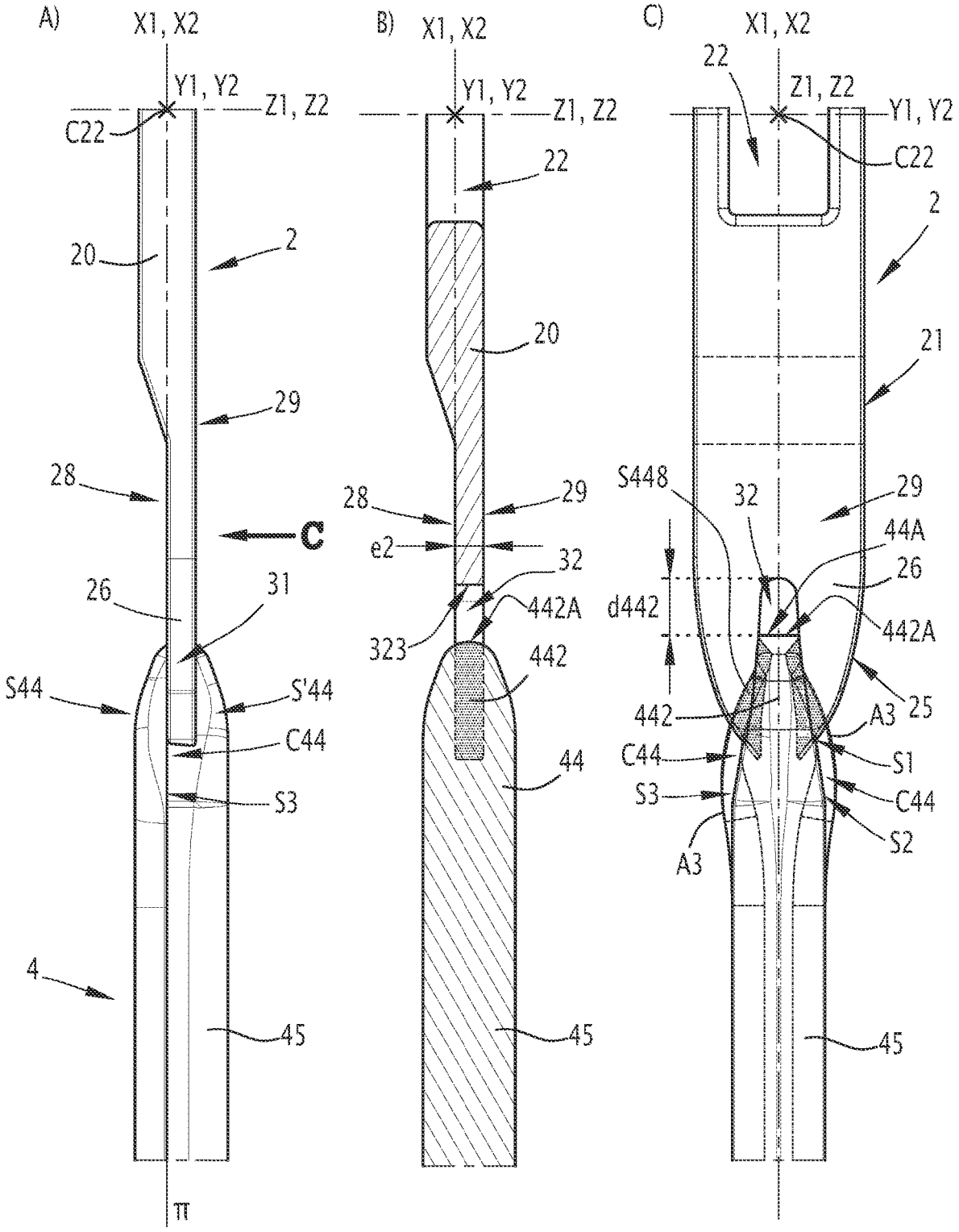
FIG. 9 shows, on three inserts A), B) and C), a side view, a longitudinal section and a front view, in the direction of arrow C on insert A), of the junction zone of the heddle of the second embodiment.
Figure 10:
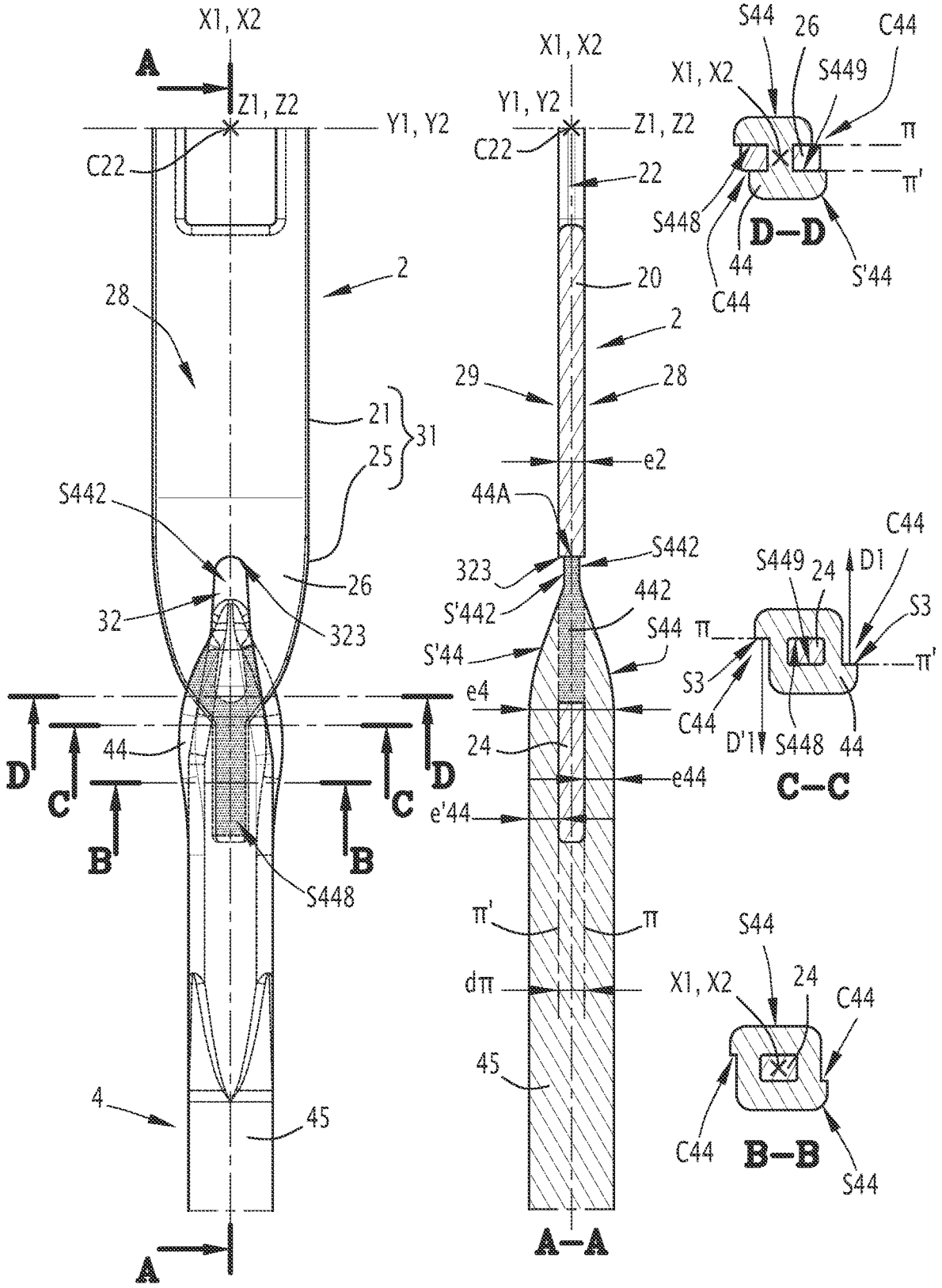
FIG. 10 is a front view similar to FIG. 6 for a heddle in accordance with a third embodiment, as well as several sections taken respectively at section lines A-A, B-B, C-C and D-D.

Another difference relative to the first embodiment is that the link 2 presents a thickness e2, measured parallel to the thickness axis Z2, which is not constant. This thickness is greater in the central portion 20, which defines the eyelet 22, than in the transition zone 26, as can be seen in FIG. 9. The transverse faces 28 and 29 are parallel to the axes X1 and Y1, except for the portion of the transverse face 28 where the thickness e2 varies.

The trace of the covering surface S448 is shaded in FIG. 9.

Two cavities C44 are respectively formed on either side of a plane containing the axes X1 and Z1 of the second longitudinal extremity 44 of the rod 4, each being defined by a first surface S1, a second side surface S2 and a third bottom surface S3. The cavities C44 have substantially the same geometry as in the first embodiment.

The variable feature of the thickness e2 allows the plane π in which is located the third bottom surface S3 of the cavities C44 to be coplanar with the median plane of the link 2 defined by the axes X2 and Y2 at the center C22 of its eyelet 22. In other words, the geometry of the link 2, which presents a reduction in thickness visible in FIG. 9, allows the parting line of the mold, that is, the plane π defined as in the first embodiment, and the third bottom surface S3 of the cavity 44 with the median plane of the link 2 to be aligned.

In this embodiment, the anchoring heel 442 does not fill the entire housing 32 in which it is overmolded. In particular, no part of the heel 442 presents surfaces comparable to the surfaces S442 and S'442 of the first embodiment. A free edge 442A of the anchoring heel 442 extends, along the longitudinal axis X1, at a non-zero distance d442 from the proximal portion 323 of the unclosed contour of the housing 32 in which this anchoring heel 442 is overmolded. The anchoring heel 442 passes right through the housing 32, between the transverse faces 28 and 29 of the link 2. In this second embodiment, the free edge 442A of the anchoring heel forms the free edge 44A of the second extremity 44 of the rod 4.

In the third embodiment, the two cavities C44 defined on either side of a plane containing the axes X1 and Z1 of a second longitudinal extremity 44 of a rod 4 of the heddle 1 have their respective third bottom surfaces S3 which are not coplanar but defined respectively in the extension of two covering surfaces S448 and S449 formed by the second longitudinal extremity 44 and which partially cover, at the transition zones 26, respectively the transverse faces 28 and 29 of the link 2. The trace of the covering surface S448 is shaded in gray in FIG. 10. This covering surface S448 is not symmetrical relative to the plane containing the axes X1 and Z1.

The third bottom surfaces S3 of the two cavities C44 arranged on either side of a second longitudinal extremity 44 are defined by two planes π and π' parallel and offset, parallel to the thickness axis Z1, by a distance dπ equal to the thickness e2 of the link 2 at the transition zones 26. In this embodiment, there is therefore no single parting line for the mold in which each rod 4 is overmolded onto the link 2. However, on the rod 4, either side of the plane X1, Y1, the parting line extends exclusively in the plane π, respectively in the plane π', which limits the formation of overmolding burrs that can create snags for neighboring warp threads.

The two cavities C44 are not limited according to the respective directions D1 and D'1 which are perpendicular to the covering surfaces S448 and S449, parallel to the axis Z1, and each oriented away from the portion of the second longitudinal extremity 44 of the rod 4 which defines the respective bottom surface S3. These two directions D1 and D'1 are opposite to each other, that is, directed upward for the direction D1 taken into account for the cavity C44 shown on the right of the section C-C of FIG. 10 and downward for the direction D'1 taken into account for the cavity C44 shown on the left of this section.

In this third embodiment, the link 2 is identical to that of the first embodiment. The heel 442 extends as far as the proximal portion 323 of the contour of the housing 32, with the surfaces S442 and S'442 defined as in the first embodiment which are respectively parallel to the transverse faces 28 and 29 of the link 2, which are not flush with these transverse faces 28 and 29 but located set back therefrom, toward the inside of the housing 32, so as not to snag the adjacent warp threads 108 when these displace into contact with the link 2.

Using the same notation conventions as for the first embodiment, we have the following relationships:

$$e4\max = e2 + e44 + e'44 \quad \text{(equation 1)}$$

$$e44 \geq e2 \quad \text{(equation 2)}$$

$$e'44 \geq e2 \quad \text{(equation 3)}$$

In this third embodiment, as in the first embodiment, the part of the anchoring heel 442 which rests against the proximal portion 323 of the closed contour of the housing 32 forms the free edge 44A of the second extremity 44 of the rod 4.

In an alternative, not represented, of the invention, the two cavities C44 of the upper rod 4, which carries the hooking means 11A, are non-facing in a first direction perpendicular to the adjacent covering surface, while the two cavities C44 of the lower rod 4, which carries the hooking means 11B, are non-facing in a second direction perpendicular to the adjacent covering surface, the second direction being opposite to the first direction. In other words, the cavities C44 provided on the upper and lower rods are not limited, perpendicularly to their respective third bottom surfaces S3, according to the directions that are opposite between the upper and lower rods. In this case, and if for each rod 4, the third bottom surfaces S3 are coplanar, the mold parting line for the upper rod 4 is offset, along the thickness axis Z1, relative to the mold parting line for the lower rod 4, by a distance equal to the thickness e2 if the link is of constant thickness as in the first and third embodiments.

According to another alternative, not represented, of the invention, the bottom surface S3 of at least one of the cavities C44 is not flat.

According to another alternative, equally not represented, the bottom surface S3 of a cavity C44 is not coplanar with a transverse face of the link, in other words, it is non-coplanar with the covering surface that it extends but is inclined relative to the latter. In this case, the bottom surface S3 effectively extends the covering surface, of the type of surface S448 or S449 mentioned above but is not parallel to the median plane of the link 2 defined by the axes X2 and Y2.

Alternatively, whatever the embodiment, the link 2 can be made of ceramic.

According to another alternative, equally not represented, of the invention, each housing 32 can be formed by several recesses, for example several circular-section holes juxtaposed along the longitudinal axis X2.

According to another alternative, equally not represented, of the invention, each housing 32 can be formed by one or more notches formed from the peripheral surface 31 of the link and opening onto the outside of the link 2 parallel to the transverse axis Y1, for example at the lateral edges 27 of the longitudinal lugs 24.

According to another alternative, equally not represented, of the invention, each housing 32 is not through-going according to the thickness axis Z1.

In all embodiments, the housing 32 allows the rod 4 to be anchored in the link 2 by means of the anchoring heel 42, this anchoring preventing the rod from separating from the link parallel to the longitudinal axis X1.

According to yet another alternative, not represented, of the invention, the first surface S1 which delimits a cavity C44 comprises, as in the embodiments shown in the figures, a portion of the surface parallel to the plane defined by the axes X1 and Y1. This first surface S1 may also comprise a portion of the lateral edges 21, parallel to the plane defined by the axes X1 and Z1.

According to yet another alternative, not represented, of the invention, the rods 4 are overmolded onto the hooking means 11A and/or 11B, particularly in the case where the materials of these hooking means are different from that of the rod 4.

According to yet another alternative, not represented, of the invention, the link 2 comprises a single longitudinal extremity lug 24.

According to yet another alternative, not represented, of the invention, a single cavity C44 in accordance with the invention is formed on a rod 4, at its second extremity 44, on a single side of a plane containing the axes X1 and Z1.

According to yet another alternative, not represented, of the invention, the heddle 1 comprises a single rod 4, or only one of the rods 4 of the heddle body 10 is provided with one or two cavities C44. In other words, the invention is implemented with a single rod 4.

Regardless of the embodiment or alternative of the invention, the presence of at least one cavity C44 on at least one second extremity 44 of a rod 4 allows to arrange the areas of the heddle where overmolding burrs are most likely to form, namely the intersection line L44 and the re-entrant edge A1, to be recessed inside the cavity C44. These areas are not reached by neighboring warp threads 108 when the heddle is integrated into a Jacquard-type weaving loom harness H, which greatly limits, or even eliminates, the risk of these warp threads being snagged by these burrs. This further reduces the need for burr removal operations. As the cavity C44, and in particular the third bottom surface S3, the first surface S1 and the second lateral surface S2 of the cavity C44, are not facing each other in a direction D1 parallel to the axis Z1 and away from the portion of the second longitudinal extremity 44 that defines this bottom surface S3, the cavity C44 does not need a slide to be formed by overmolding in a mold in which the parting line or lines are perpendicular to the axis Z1, which has little tendency to generate burrs.

The above-mentioned embodiments and alternatives may be combined, insofar as this is technically feasible.

The invention claimed is:

1. A heddle for guiding a warp thread for a weaving loom equipped with a Jacquard mechanism, the heddle extending lengthwise according to a longitudinal axis and comprising:

a link, with an eyelet for passage of the warp thread, the eyelet passing through the link between a first transverse face and a second transverse face of the link, the first and second transverse faces being connected together by a peripheral surface of the link;

at least one rod of polymeric material extending according to the longitudinal axis, which is provided with an outer surface and comprising:

a first longitudinal extremity provided with the means for connection to a member of a harness, of the Jacquard mechanism; and a second one-piece longitudinal extremity comprising at least a first covering surface which partially covers the first transverse face of the link, a second covering surface which partially covers the second transverse face of the link, and an anchoring heel;

wherein the first covering surface and the second covering surface are parallel to the longitudinal axis and to a transverse axis, perpendicular to the longitudinal axis;

wherein the link cooperates with the anchoring heel of the rod to oppose separation of the rod and link parallel to the longitudinal axis, and wherein the rod and the link form, at the second longitudinal extremity of the rod, at least one cavity which is offset from the link according to a direction parallel to the longitudinal axis and which is delimited by a first surface formed by a portion of the peripheral surface of the link;

a second lateral surface formed by a portion of the outer surface of the rod, this second lateral surface extending toward the first longitudinal extremity of the rod, from an intersection line between the peripheral surface of the link and the outer surface of the rod;

a third bottom surface formed by the rod and extending one of the first and second covering surfaces toward the first longitudinal extremity of the rod;

within each cavity, the intersection line extends from the third bottom surface and delimits the first surface;

for each cavity, the third bottom surface is arranged according to a direction parallel to the transverse axis, toward an outside of the rod relative to the second lateral surface; and each cavity is non-facing, according to a thickness axis, perpendicular to the longitudinal and transverse axes, in a direction away from a portion of the rod which forms the third bottom surface of the cavity.

2. The heddle according to claim 1, wherein the third bottom surface of each cavity is coplanar or substantially coplanar with the covering surface which it extends.

3. The heddle according to claim 1, wherein the link comprises at least one housing passing through the link between the first transverse face and the second transverse face of the link;

the anchoring heel passes right through the housing of the link according to the thickness axis;

a contour surface of the housing comprises a proximal portion, arranged longitudinally on a side of the eyelet;

the proximal portion of the housing is arranged, along the longitudinal axis, between the cavity or cavities formed on the rod and the eyelet;

the anchoring heel forms a free edge of the second longitudinal extremity;

the first and second covering surfaces of the rod extend to the anchoring heel.

4. The heddle according to claim 3, wherein the anchoring heel of the second longitudinal extremity of the rod is delimited by two surfaces respectively parallel to the first and second transverse faces of the link; and the anchoring heel rests longitudinally against the proximal portion of the contour surface of the housing.

5. The heddle according to claim 1, wherein the intersection line extends to an edge bordering the second covering surface.

6. The heddle according to claim 1, wherein the heddle comprises two rods of polymeric material, each with a first longitudinal extremity and a second longitudinal extremity;

the second longitudinal extremities of the two rods each partially cover the first and second transverse faces of the link;

two cavities are formed at the second longitudinal extremity of each rod on either side of a plane containing the longitudinal and transverse axes and passing through a geometric center of the eyelet.

7. The heddle according to claim 6, wherein the two cavities formed at the same second longitudinal extremity of the same rod are not opposite each other according to the same direction parallel to the thickness axis;

the link is plane and symmetrical relative to a geometric center of the eyelet.

8. The heddle according to claim 1, wherein the first surface is formed by a portion of the peripheral surface of the link in a transition zone of the link where a width of the link, taken according to the transverse axis, decreases away from the eyelet along the longitudinal axis.

9. The heddle according to claim 1, wherein the third bottom surface is delimited according to the transverse axis toward the outside of the rod by a joining edge which connects the third bottom surface to the outer surface of the rod, which is curved and a concavity of which faces toward the second bottom surface.

10. The heddle according to claim 9, in which the joining edge extends at a distance from the intersection line, a minimum value of which is greater than or equal to half the thickness of the link, measured between the first and second covering surfaces according to the thickness axis.

11. The heddle according to claim 9, wherein a radius of curvature of a projection of the joining edge in a plane parallel to the longitudinal and transverse axes is greater than or equal to a radius of curvature of the projection of the first surface in this plane.

12. The heddle according to claim 11, wherein the radius of curvature of the projection of the joining edge in the plane parallel to the longitudinal and transverse axes is at least 1.5 times greater than or equal to the radius of curvature of the projection of the first surface in this plane.

13. The heddle according to claim 1, wherein, at a longitudinal level of the cavity and on a side of each covering surface according to the thickness axis, the second longitudinal extremity of the rod has a thickness, measured according to the thickness axis relative to a plane formed by the covering surface, which is greater than or equal to a thickness of the link measured between the first and second covering surfaces.

14. The heddle according to claim 1, wherein, on a side of each covering surface according to the thickness axis, the second longitudinal extremity of the rod presents, longitudinally between the third bottom surface and a free edge of the second longitudinal extremity, a width, measured parallel to the transverse axis, decreasing in the direction of the free edge; and a thickness, measured according to the thickness axis, decreasing in the direction of the free edge.

15. The heddle according to claim 1, wherein the link comprises at least one longitudinal extremity lug which is completely surrounded by the second longitudinal extremity of the rod.

16. A weaving machine equipped with a Jacquard mechanism and several heddles for guiding a warp thread, wherein at least one of the heddles is according to claim 1.

* * * * *